United States Patent [19]

Badalamenti

[11] 4,335,529

[45] Jun. 22, 1982

[54] TRACTION DEVICE FOR SHOES

[76] Inventor: Michael J. Badalamenti, 1478 Perry Lake Rd., Ortonville, Mich. 48462

[21] Appl. No.: 966,346

[22] Filed: Dec. 4, 1978

[51] Int. Cl.[3] ..... A43B 23/28; A43B 5/00

[52] U.S. Cl. ..... 36/59 R; 36/114; 36/129

[58] Field of Search ..... 36/59 R, 59 C, 67 R, 36/67 D, 7.6, 7.7, 127, 129, 62, 114, 132, 134, 128, 114, 32 R

[56] References Cited

U.S. PATENT DOCUMENTS

| | | | |
|---|---|---|---|
| 792,867 | 6/1905 | Wenz | 36/59 R |
| 1,252,764 | 1/1918 | Zielinski | 36/59 R |
| 2,179,942 | 11/1939 | Lyne | 36/59 R |
| 4,194,310 | 3/1980 | Bowerman | 36/59 R |

FOREIGN PATENT DOCUMENTS

| | | | |
|---|---|---|---|
| 1944609 | 3/1971 | Fed. Rep. of Germany | 36/128 |
| 1946620 | 5/1971 | Fed. Rep. of Germany | 36/59 R |
| 2618588 | 11/1977 | Fed. Rep. of Germany | 36/59 R |
| 407499 | 3/1934 | United Kingdom | 36/127 |

*Primary Examiner*—James Kee Chi

*Attorney, Agent, or Firm*—Basile, Weintraub & Hanlon

[57] ABSTRACT

A lateral traction device is provided for use in combination with shoes. The device employes a traction surface, adapted to be mounted to at least one side of the shoe for enabling gripping of a surface when the shoe is rotated about a horizontal axis.

8 Claims, 3 Drawing Figures

TRACTION DEVICE FOR SHOES

BACKGROUND OF THE INVENTION

A. Field of the Invention

The present invention pertains to footwear. More particularly, the present invention pertains to traction surfaces for footwear, primarily for use in active sports.

B. Prior Art Statement

Shoes having traction providing surfaces have long been known in the art. A variety of cleated shoes are commonly used, as are shoes having rough or treaded soles. However, all such traction-providing shoes known in the art have traction surfaces disposed only along the bottom surface of the shoe. None of the shoes known in the art, of which applicant is aware, provide a traction surface along the lateral surfaces of the shoe.

In walking or running it is generally the bottom surface of the shoe which comes in contact with the ground or floor. However, in abrupt stopping or turning, such as is encountered in playing football, soccer or the like, the foot often rotates about its horizontal axis. Upon such occurances it is the lateral sides of the shoe which receive a substantial amount of force. Because no traction surface is provided, there is a tendency for the side of the shoe, which is usually smooth, not to grip the surface, but to slide laterally often causing the wearer to fall. This has proved a fruitful source of injury.

Therefore, great advantages would be realized by providing a footwearer article with a traction surface which is carried along one or both sides of a shoe to facilitate stopping and turning, as well as, preventing the shoe from sliding laterally.

Thus, an object of the present invention is to provide a shoe having incorporated therewith a traction gripping surface along one or both sides thereof.

It is a further object of the present invention to provide a traction gripping surface extending laterally of the shoe along the outer or inner side.

C. Prior Art Statement

U.S. Pat. No. 2,437,143, No. 2,343,373, No. 2,458,122, No. 2,107,617 and No. 2,211,291 comprise the most pertinent prior art of which Applicant is aware.

SUMMARY OF THE INVENTION

In accordance with the present invention, there is provided a traction device which is used in combination with footwear and particularly with athletic footwear. In a first embodiment of the present invention a traction surface comprising a ground gripping surface is integrally formed on the outer and/or inner side of a shoe.

In an alternate embodiment of the present invention, the traction device is provided with means for mounting the traction device to an existing shoe.

In practicing the present invention it is to be understood that the traction surface may be deployed on either side of a shoe or on both sides of a shoe, as required, to provide lateral traction for various forms of athletic activities.

For a more complete understanding of the present invention reference is made to the following detailed description and accompanying drawing. In the drawing, like reference characters refer to like parts throughout the several views in which:

DESCRIPTION OF THE PREFERRED EMBODIMENTS

Figure 1:
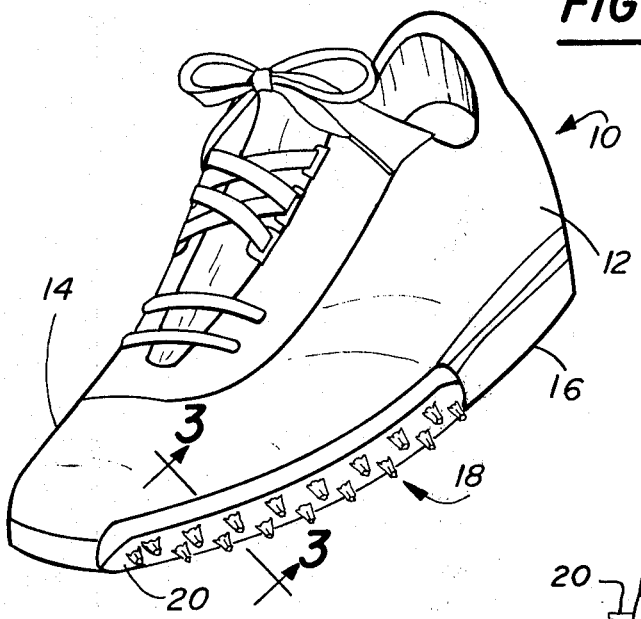
FIG. 1 is a perspective view of a first embodiment of the traction device hereof, in accordance with the present invention.

Now and with reference to the drawing, and in particular, FIG. 1, there is depicted therein an athletic shoe denoted generally at 10. The shoe 10 is of generally standard construction, having a lacing enclosure and a leather or canvas upper portion. The shoe 10 comprises an outer side 12, an inner side 14 and a sole portion 16 which may be treaded to provide a non-slip surface. Likewise, the sole of the shoe may have cleats mounted thereon.

The shoe 10 includes a traction device in accordance with the present invention and, indicated, generally, at 18. The traction device 18 comprises a traction surface 20 which is deployed along a lateral side 14 or 12 of the shoe 10 and which is adapted to conform to the shape thereof. Optimal results are achieved when the device 18 extends along the side of the shoe from about the forward portion of the heel to commencement of the toe region, as shown. Furthermore, the traction surface is disposed above the sole 16. The traction surface is angularly inclined with respect to the sole at an acute angle thereto, i.e. less than 90°.

It is to be understood that in practicing the present invention a traction device 18 may be positioned on either or both sides of the shoe 10. Hence a device 18 to be deployed along the inner side 14 of the shoe 10 will be constructed to conform to the inner contour and likewise a device on the exterior side of the shoe will be likewise conformed.

As shown in the drawing, the traction surface 20 is provided with traction means, indicated generally at 22. The means 22, preferably, comprises a plurality of nubs or cleats 24 which project outwardly from the surface 20. Preferably, the cleats 24 are normal to the surface 20. Alternatively, the surface 20 may be grooved or treaded, to enable traction in view of the cleats.

As noted, the traction device 18 is formed integrally with the shoe 10 by any suitable mode, such as molding or the like.

In use, when the wearer is turning or stopping causing the foot to rotate about its horizontal axis, force is applied to the sides of the shoes. As the foot rotates, the traction surface is brought into contact with the ground, thereby preventing the shoe 10 from skidding along the ground surface. By preventing the shoe 10 from skidding along the ground surface as force is applied thereto, the athletes' foot is prevented from slipping laterally and causing a serious fall and concommitant injury. Because of the acute angle of the surface 20, minor foot rotation, such as when a runner is making a sudden turn or "cut" causes contact, between the surface and the ground. This is extremely advantageous with synthetic turfs.

Figure 2:
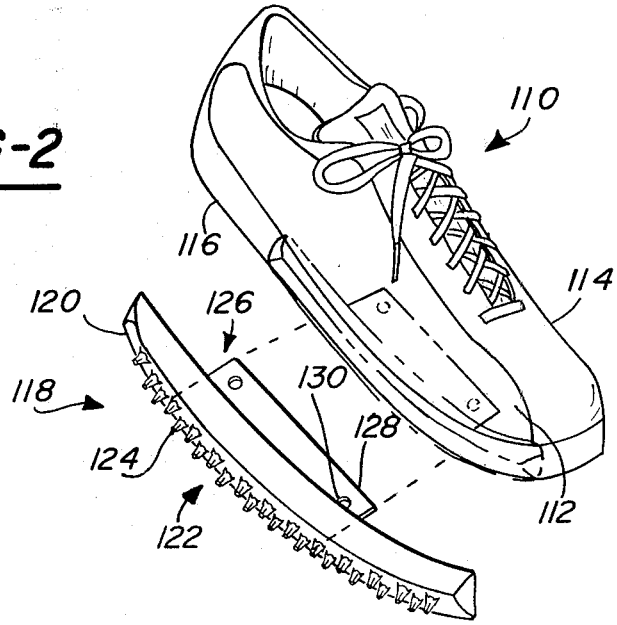
FIG. 2 is a perspective view of a second embodiment of the present invention.

Now, and with particular reference to FIG. 2, there is depicted therein a second embodiment of the present invention. In accordance herewith a traction device 118 comprises means for mounting the device to a portion of the shoe 110, such as the sole 116. The traction device 118 comprises a traction surface portion 120 which is adapted to fit snuggly against and conform to the contour of an outer side 112 or inner side 114 of the shoe 110.

The traction surface portion 120, comprises a traction means 122 which may comprise any suitable traction device such as a treaded or grooved surface composition, or preferably may comprise a plurality of nubs or cleats, shown at 124 which protrude laterally from the surface 120. As in the first embodiment, the surface 120 is disposed at an acute angle, i.e. less than 90° with respect to the sole 116.

As noted, the traction device 118, further comprises mounting means, such member 126 formed with the surface 120. The member 126 comprises a plate which extends from the traction member 120 proximate the lower surface thereof. The mounting member 126 is, preferably, integrally formed with the traction member 120 or otherwise permanently secured thereto. The mounting member 126 is adapted to be secured to the shoe 110 to enable the traction surface 120 to be butted against the side 112 or 114 of the shoe 110 without impeding athletic activity. The mounting member includes attachment means 128 for securely attaching the device 118 to the shoe 110.

The attachment means 128 comprises any suitable mounting means, such as apertures 130 suitable to receive nails, screws, or other suitable mounting hardware which may project therethrough and into the footwear item associated therewith.

In practicing the second embodiment of the invention, any conventional athletic shoe is fitted with the lateral traction device along either side thereof by positioning the device 118 such that the traction portion 120 abuts the selected side of the shoe at the desired point. The device 118 is then secured to the shoe with the requisite mounting hardware being inserted through the mounting apertures 130 into the shoe.

Thus, by this second embodiment, conventional athletic or other shoes may be equipped with lateral gripping traction means thereby enhancing their safety and usefulness in athletic activities which require abrupt stopping and turning.

Figure 3:
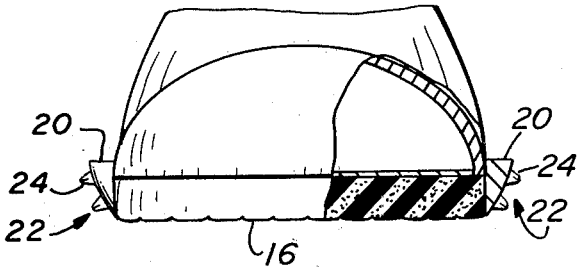
FIG. 3 is a cross-sectional view taken along line 3—3 of FIG. 1.

The traction device hereof may be fabricated from any suitable material such as rubber or synthetic resinous material. Also, because the surface 20 or 120 is inclined, it is preferably wedge-shaped, as shown in FIG. 3, hence the wedge provides a shoe-engaging surface and a traction surface.

It is to be appreciated that the present invention defines a new footwear item as well as enabling modification of existing footwear items.

Having, thus, described the invention what is claimed is:

1. A running shoe comprising an outer side, an inner side, a sole, a first traction surface, and a second traction surface, wherein: said first traction surface and said second traction surface are associated with and disposed on the inner side and the outer side, respectively, of the upper portion of said shoe; each of said traction surfaces extends along a side of said shoe from about the forward portion of the heel to about the region where the toe area commences; and each of said traction surfaces is disposed above said sole of the shoe at an acute angle; whereby, when said shoe is rotated about a horizontal axis, at least one of said traction surfaces is brought into contact with the ground surface.

2. The shoe of claim 1 wherein the traction surfaces are integral with the shoe.

3. The shoe of claim 1 which further comprises means for mounting the traction surfaces to the shoe.

4. The shoe of claim 1 which further comprises a mounting member connected to an associated traction surface, the mounting member including means for mounting the associated traction surface to the shoe.

5. The device of claim 4 wherein said mounting member has at least one aperture formed therethrough which defines the mounting means, the aperture receiving a fastener therethrough.

6. The shoe of claim 1 wherein the traction surfaces comprise a plurality of nubs protruding from the traction surface.

7. The shoe of claim 1 wherein the traction surfaces have a treaded surface formed thereon.

8. The device of claim 6 wherein the ends of the nubs are disposed above the horizontal plane of the sole of the shoe.

* * * * *